United States Patent [19]

Lemmer

[11] Patent Number: 4,594,484

[45] Date of Patent: Jun. 10, 1986

[54] SWITCH BRIDGE ARRANGEMENT FOR AN ELECTRICAL SWITCH

[75] Inventor: Helmut Lemmer, Marienheide-Kalsbach, Fed. Rep. of Germany

[73] Assignee: Square D Starkstrom GmbH, Marienheide-Rodt, Fed. Rep. of Germany

[21] Appl. No.: 713,267

[22] Filed: Mar. 18, 1985

[30] Foreign Application Priority Data

Mar. 31, 1984 [EP] European Pat. Off. ..... 84103593.4
Oct. 24, 1984 [EP] European Pat. Off. ..... 84112789

[51] Int. Cl.[4] ..... H01H 3/02
[52] U.S. Cl. ..... 200/16 A; 335/132
[58] Field of Search ..... 200/16 R, 16 A, 16 B, 200/16 C, 16 D, 16 E, 16 F, 50 C, 243, 245, 247, 249, 250, 251, 280, 281; 335/132

[56] References Cited

U.S. PATENT DOCUMENTS 3,260,824 7/1966 Schleicher ..... 335/193
3,964,006 6/1976 Lacan ..... 335/132

FOREIGN PATENT DOCUMENTS 180734 9/1962 Sweden ..... 200/280

*Primary Examiner*—A. D. Pellinen
*Assistant Examiner*—Morris Ginsburg
*Attorney, Agent, or Firm*—Michael J. Striker

[57] ABSTRACT

In a switching bridge arrangement for an electrical switch, such as a circuit breaker, wherein a plurality of contact bridges, biased by contact springs, are movable in a plurality of windows provided in the switch housing, each contact spring is formed as a leaf spring pressed in the respective window against the contact bridge and is provided with a recess in which a projection formed on the wall of the window is engaged.

13 Claims, 12 Drawing Figures

SWITCH BRIDGE ARRANGEMENT FOR AN ELECTRICAL SWITCH

BACKGROUND OF THE INVENTION

The present invention pertains to a switching bridge for an electrical switch, particularly for a safety switch.

A switch bridge arrangement of the type under discussion normally includes a number of contact bridges superposed on each other or positioned one after another and arranged movably in the windows or openings of the switch bridge housing. The contact bridges which support at their ends contact pieces are normally positioned under the pressure of respective pressure or contact springs.

Switch bridge arrangements of the foregoing type are known. All contact springs in such switch bridge arrangements are formed as helical springs which are inserted in respective windows of the switch housings so that one end of each spring is supported against the lower wall of the window whereas the other end of the spring is supported against the respective contact bridge. The disadvantage of such arrangements resides in that only a manual assembling of such an arrangement is possible due to the fact that each contact bridge can be inserted into the window and properly placed with respect to the helical spring by hand. A further disadvantage of conventional arrangements is that the helical spring presses against the contact bridge only in the middle thereof and no support of the contact bridge can be effected. Thus each contact bridge is provided in the longitudinal direction with two-side projections or similar guide pieces which would engage at the edges of the window and thereby hold the contact bridges against displacement in the longitudinal direction. In case of a great number of switching movements, which each contact bridge performs in the window, an extremely great rubbing action between the switch housing and the contact bridge, both made in the region of the window of synthetic plastic material, will result. This rubbing occurs at least partially on the contact pieces which become contaminated. Thus the contact safety is negatively affected after some time of use of the switch.

SUMMARY OF THE INVENTION

It is an object of the present invention to provide an improved switching bridge arrangement.

It is another object of this invention to provide a switch arrangement which could be automatically assembled and in which contacts and the contact bridge would be such that rubbing would be practically avoided, and good contact safety would be ensured.

These and other objects of this invention are attained by a switch bridge arrangement for electrical switches, particularly safety switches, comprising a housing having at least one window; at least one contact bridge movably positioned in said window and carrying at ends thereof contact pieces; and at least one contact spring, said contact bridge being under pressure of said spring, said spring being convexly curved with respect to said contact bridge and being formed as a leaf spring, said leaf spring having an arresting means, said housing having in the region of said window side walls and a wall portion, said arresting means cooperating with said wall portion to form a locking connection therewith, said leaf spring having two opposite ends, said contact bridge having opposite ends, the opposite ends of said leaf spring and the opposite ends of said contact bridge being concavely curved in the same direction and cooperating with each other, said contact bridge being supported in a longitudinal direction thereof by said leaf spring and in a transverse direction thereof by said side walls.

Tests have surprisingly shown that practically no rubbing occurs in the switch bridge arrangement of the invention even after a long period of use. The manufacture of the bridge arrangement by automatic machines is easily attainable because each contact bridge can be easily preassembled with the leaf spring. With a slight prestressing the leaf spring can be easily inserted together with the contact bridge into a respective window of the switch housing so that no canting or the like would be required. When the leaf spring is in the inserted position the arresting means on the spring becomes engaged with the wall portion of the window wall so that a locking connection results, and the contact bridge and the contact spring are reliably held to each other.

The leaf spring may be formed with two elongated slots extended toward the opposite ends thereof.

The contact bridge may be formed with two elongated slots extended toward the opposite ends thereof, the slots of the contact bridge forming two pairs of parallel elongated arms, each arm carrying thereon one of said contact pieces.

The arresting means may be an opening formed in said leaf spring, said wall portion being a projection extended into said window and engaged in said opening.

The arresting means may be a rib formed on said spring, said wall portion being a projection extended into said window and engaged with said rib.

Alternatively, the switch bridge arrangement may be formed such that the contact bridge itself would be made of a spring-elastic and electrically conductive material and formed as a frame having portions which form between the contact bridge and said contact pieces at least one contact spring. In such an embodiment, no rubbing effect occurs in the operation of the switch either.

The frame may be made of electrically conductive metallic strip and have in the middle of said window bent-over end portions which extend inwardly of the window and closely abut against each other.

The end portions have surfaces abutting against each other; said surfaces may be provided with silver coating.

The frame has inner ends provided with said inner portions and may be formed at each inner end with a recess, said housing being formed with a projection extending into said window and engaged in the recesses of said frame.

The frame may be substantially rectangular and have a continuous bottom portion having an underside, said contact pieces being arranged on said underside.

The frame has two outer ends and may be provided at said outer ends with two elongated opposing slots at two sides of said window.

In yet another modification of the switching bridge arrangement the contact bridge may have two upwardly bent end projections, said spring being formed with two openings in which said projections are engaged.

In still another modification the contact spring may be C-shaped and have two opposite ends, said contact bridge having two folded projections, said opposite ends of the spring being supported against said folded projections.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
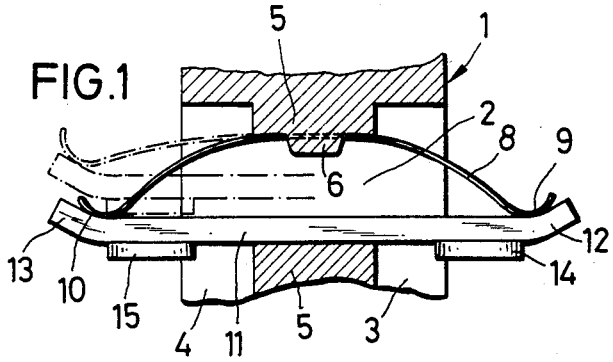
FIG. 1 is a side view, partially in section, of a switch arrangement with a contact bridge and a pressure spring in inserted ready-to-operate position.
Figure 3:
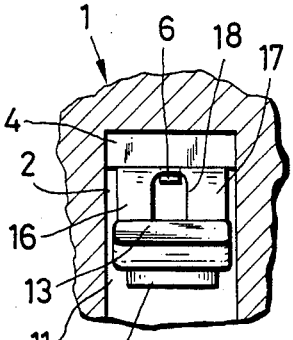
FIG. 3 is a front view of FIG. 1.
Figure 2:
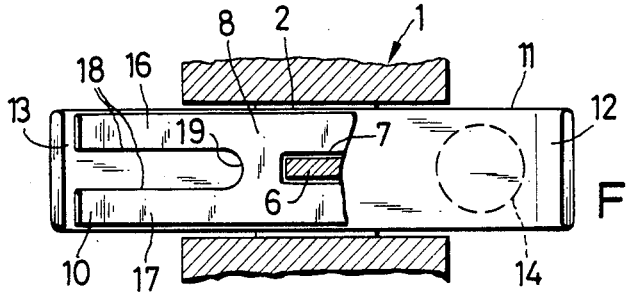
FIG. 2 is a top plan view, partially in section, of the switch arrangement of FIG. 1.

Referring now to the drawings in detail, FIGS. 1 through 3 illustrate a first embodiment of the switch arrangement, which includes a switching bridge housing 1 having a window or opening 2 transversely extended therein. The switching bridge 1 can also have a number of windows positioned one above another and/or one after another so that the structure of the switching arrangement disclosed hereinbelow would be the same for each window.

In the embodiment according to FIG. 1, two recesses 3 and 4 are provided at both sides of window 2 whereby the window 2 is actually formed in a web 5 of the switching bridge 1. The remaining edges of the switching bridge which project beyond web 5 are formed as reinforcement ribs.

A projection 6 is formed on the upper side of web 5. Projection 6 is preferably of a rectangular cross-section as clearly shown in FIG. 2. Projection 6 is engaged in an opening 7, also of rectangular cross-section, formed in a contact or pressure spring 8, and holds this contact spring in each operational position and also secures this spring against rotation.

The pressure spring 8 is formed as a leaf spring convexly curved relative to a contact bridge 11 positioned below spring 8. Two opposite ends 9 and 10 of the leaf spring 8 and two opposite ends 12 and 13 of the contact bridge 11 are somewhat concavely curved in the upward direction. Thereby, the ends of the contact bridge are positioned under spring pressure and cooperate with the ends of the spring so that the contact bridge 11 is held in the longitudinal direction by the spring 8.

As clearly seen from FIG. 2, the contact bridge 11 is supported in the transverse direction by the side walls forming the window 2. The contact bridge 11 preferably has straight-line longitudinal edges and is made of a substantially rectangular electrically conductive metal strip. With such an arrangement and support the contact bridge practically never comes into frictional contact with the side walls of the window so that rubbing of the side walls of the contact bridge with the side walls of the window would not be produced.

In the embodiment of FIGS. 1 through 3 the contact bridge 11 is massive and solid and carries on the underside thereof two contact pieces 14 and 15.

The pressure spring 8 has at two opposite ends thereof longitudinal or axial slots 18 (only one slot 18 is shown in FIG. 2). Each slot 18 has a rounded inner end surface 19. Each slot 18 forms at the end of the spring two opposite resilient or elastic arms 16 and 17. Due to such an arrangement, the contact safety would be further ensured because the spring 8 presses against the contact bridge 11 at many locations.

Figure 4:
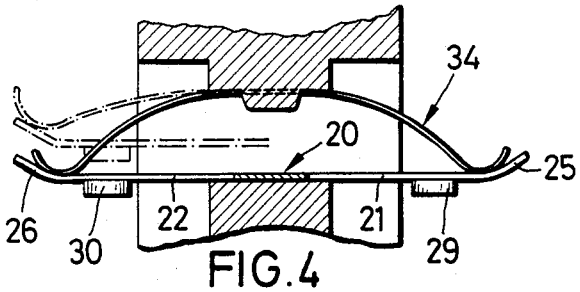
FIG. 4 is a partial sectional view of the switch arrangement with a contact bridge of a modified embodiment.
Figure 6:
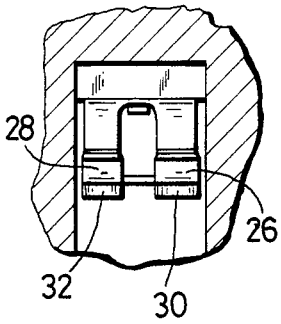
FIG. 6 is a front view of FIG. 4.
Figure 5:
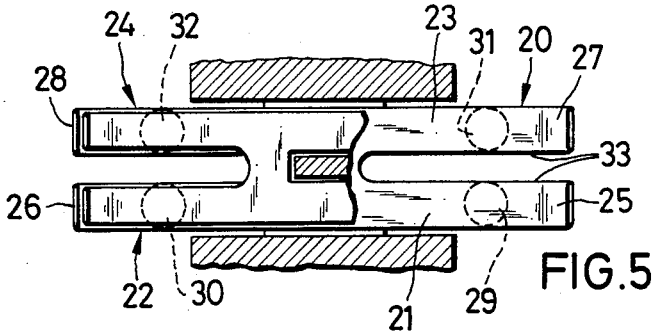
FIG. 5 is a top plan view, partially in section, of FIG. 4.

With reference to FIGS. 4 through 6 it will be seen that a contact bridge 20 is in this embodiment somewhat thinner and less massive than that of FIGS. 1-3. The contact bridge 20 is formed at two opposite ends thereof with two elongated slots 33 so that two pairs of arms, namely arms 21, 23 and 22, 24, parallel to each other are formed on bridge 20. Each arm carries a contact piece 29, 30, 31, 32, respectively. Such a construction provides for a further improvement in the switch safety. The concavely curved ends of a pressure spring 34 cooperate with the concavely curved ends 25, 26, 27 and 28 of the respective arms 21 to 24.

In the above disclosed embodiments an arresting means of the contact spring, formed as a leaf spring, is an opening 7 in which the projection 6 is engaged. In place of such an opening however, a rib, also normally extending to the plane of the drawing, can form the arresting means. Such transversal rib can be curved downwardly so as to engage with the projection 6 and form therewith a form-locking connection. Alternatively, the transversal rib can be curved upwardly. In such an instance a notch or recess would be provided in a respective wall of the window so as to receive and engage that rib.

Figure 7:
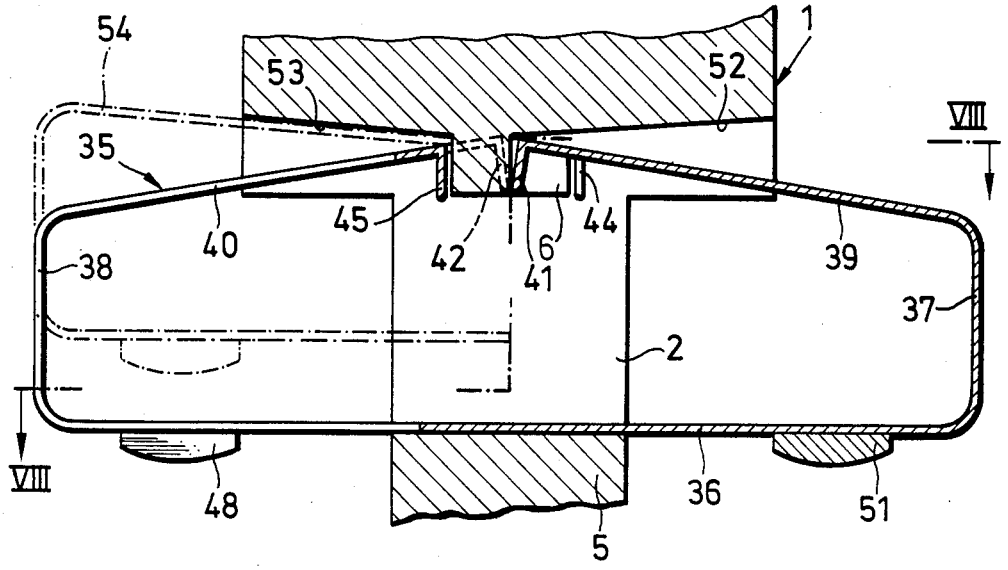
FIG. 7 is a sectional view taken on line VII—VII of FIG. 8 and illustrating a contact bridge of yet another embodiment of the invention.
Figure 8:
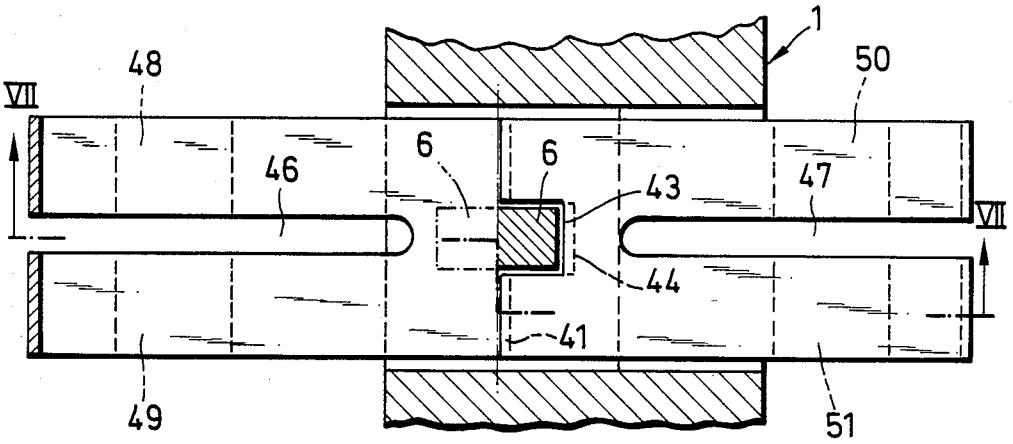
FIG. 8 is a sectional view taken along line VIII—VIII of FIG. 7.

In the embodiment illustrated in FIGS. 7 and 8 a contact bridge which is made of a spring-elastic or resilient material and formed of electrically conductive, comparatively thin metallic strip, has the form of a frame 35. Frame 35 has a continuous bottom portion 36, to the underside of which contact pieces 48, 49 and 50, 51 are secured. Frame 35 further includes upwardly extending vertical frame portions 37 and 38 which merge via rounded corners from the bottom portion 36. Vertical portions 37 and 38 in turn merge, also through the rounded corners, into the upper, inwardly extending respective frame portions 39 and 40. Frame 35 is substantially rectangular, but each frame portion 39 and 40 in the rest position as shown in FIG. 7 slopes somewhat upwardly in the inward direction. The contact pieces 48 through 51 are arranged on the outer side of the bottom portion 36 and are positioned at the ends of this bottom portion. Frame 35 can be formed of a continuous or non-interrupted metallic strip, manufactured, for example by the separation from a tube and by deforming. For the manufacturing reasons it is also expedient that the contact bridge would be stamped out from a flat metallic strip and then formed into a rectangular frame. In this case ends 41 and 42 of such metallic strip would be bent over in the middle area of window 2 and would be shaped so that these ends would be tightly positioned one against the other. Advantageously, ends 41 and 42 can be provided at the surfaces thereof, facing toward each other, with silver coatings to ensure good electrical conductivity and current transmission. With the contact bridge formed as frame 35, a two-surface electrically conductive connection is available between contact pieces 48 and 49, on the one hand, and between contact pieces 50 and 51, on the other hand. A selfelastic or spring-elastic material for the contact bridge is selected so that frame 35 simultaneously forms a pressure spring for the contact bridge.

In the embodiment of FIGS. 7 and 8, ends 41 and 42 of frame portions 39 and 40 are bent inwardly. In the region of each of these ends a recess 43, for example of rectangular shape, is provided. Projection 6, which extends into the window 2, is engaged in both recesses 43. Upon automatic contact of the switching bridge housing 1 with the frame-shaped contact bridge 35 it is required that frame 35 would be displaced into the window 2 from one side. As seen from the left-hand portion of FIG. 7 the frame portion 39 is firstly elastically pressed via projection 6 downwardly and projection 6 becomes engaged in recesses 43 whereby the position of the frame is secured. For a better holding downwardly-bent ends 44 and 45 can be provided on the inner edges of recesses 43.

Alternatively, it is possible to bend the above mentioned ends of frame portions 39 and 40 upwardly and to provide, instead of projection 6, a recess in the window wall so that the upwardly bent ends of the frame portions would be engaged in that recess.

To further improve contact safety frame 35 can be provided in the region of window 2 at both sides thereof with elongated slots 46 and 47 as shown in FIG. 8. Four contact pieces 48 to 51 are then secured to the respective arms formed by those slots.

As further shown in FIG. 7 slightly oblique and outwardly ascending supporting surfaces 52 and 53 are provided on the inner wall of the switching bridge 1. In the operational position which is shown by dash-dotted line 54 the frame portions 39 and 40 can abut against the supporting surfaces 52 and 53. Frame portions 39 and 40 execute between an inoperative position and an operative position a certain pivoting motion which can be readily observed from FIG. 7. The bent-over ends 41 and 42 perform a predetermined rolling motion relative to each other so that, on their surfaces facing each other, a self-cleaning effect occurs which would always ensure good current transmission.

Figure 9:
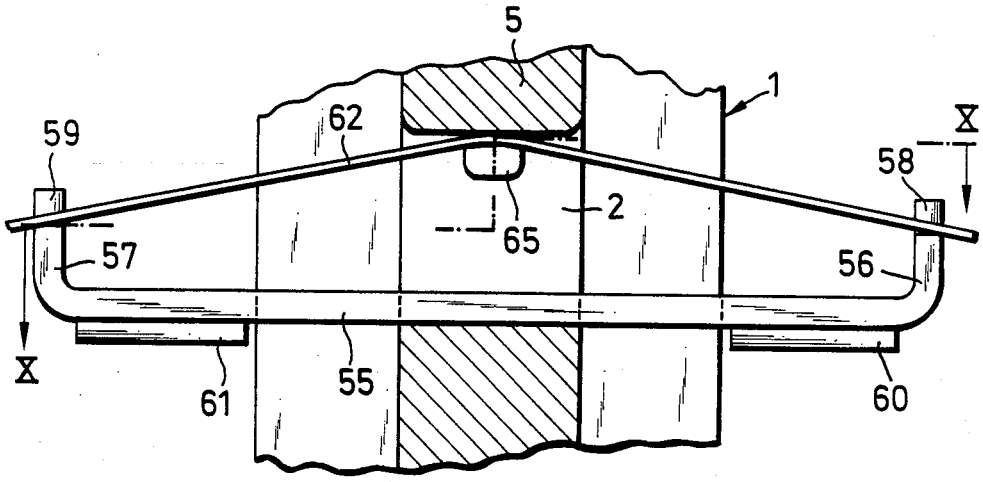
FIG. 9 is a side view of still another embodiment of the contact bridge.
Figure 10:
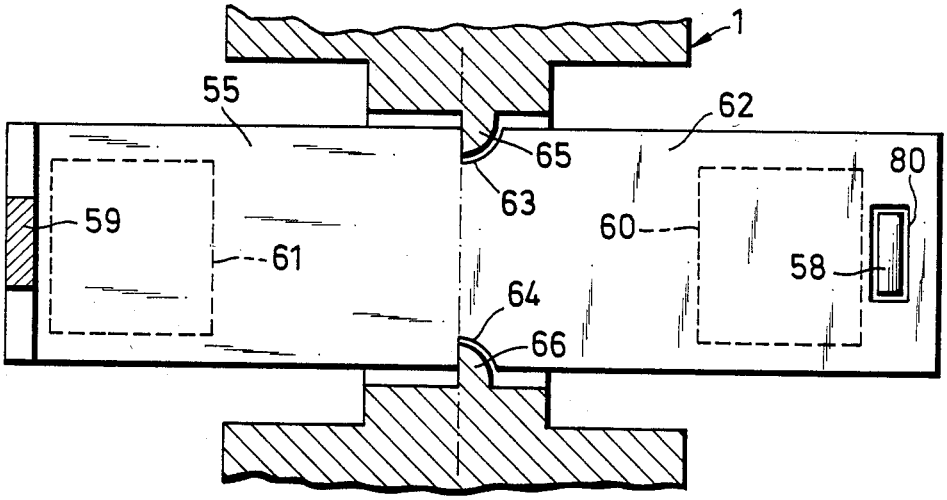
FIG. 10 is a sectional view taken along line X—X of FIG. 9.

FIGS. 9 and 10 show the switching arrangement in which a specifically reliable support of the contact bridge 55 is provided. Ends 56 and 57 of the contact bridge 55 are bent over upwardly by approximately 90°. Central projections 58 and 59 are formed at the upper sides of the ends 55 and 56. Each projection 58, 59 is engaged in a respective hole 80 formed in a pressure spring 62 at each end thereof. Contact pieces 60 and 61 are secured to the underside of the contact bridge 55. Semi-circular recesses 63 and 64 are provided at both opposite longitudinal sides of the spring 62. Projections 65 and 66 extended from the opposite webs of the switching bridge 1 into the window 2 are respectively engaged in recesses 63 and 64. An automatic contact is possible in this embodiment by a simple displacement of the contact bridge 55 with the pressure spring 62.

Figure 11:
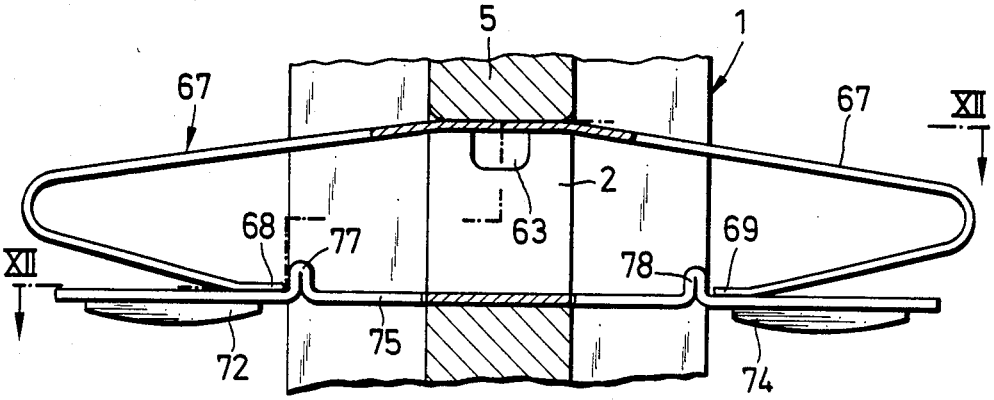
FIG. 11 is a side view, partially in section of a further embodiment of the invention.
Figure 12:
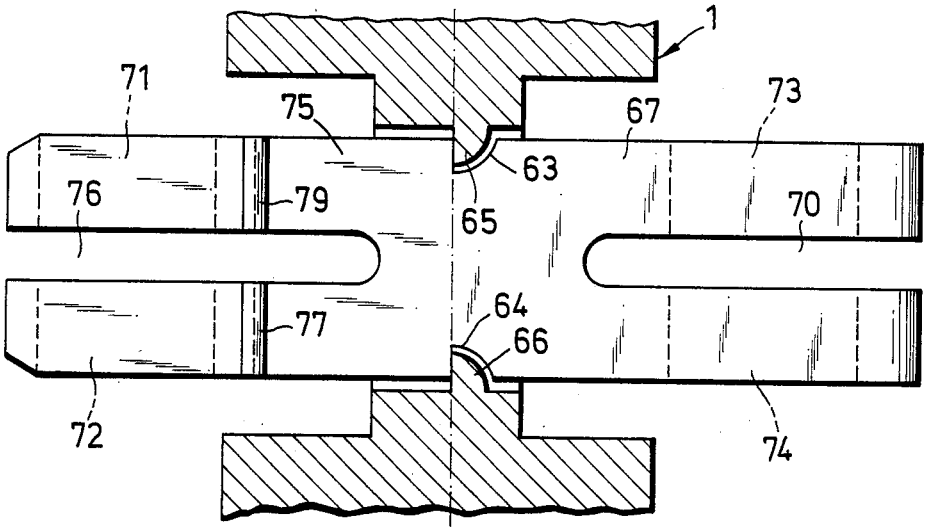
FIG. 12 is a sectional view taken along line XII—XII of FIG. 11.

In the embodiment illustrated in FIGS. 11 and 12 a pressure spring 67 is C-shaped. This spring has two ends 68 and 69 which extend inwardly and face each other. These ends abut against respective folded portions 77, 79 and 78 formed on the contact bridge 75. The latter carries on its underside contact pieces 71, 72, 73 and 74. To enhance contact safety pressure spring 67 and contact bridge 75 have elongated slots 70 and 76 forming the pairs of arms similarly to the above described embodiments.

It is of course understood that all the figures show the switching arrangements in enlarged scale, which is here 10:1.

It will be understood that each of the elements described above, or two or more together, may also find a useful application in other types of switch arrangements for electrical switches differing from the types described above.

While the invention has been illustrated and described as embodied in a switch arrangement, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A switch bridge arrangement for safety switches, comprising a housing having at least one window; at least one contact bridge movably positioned in said window and carrying at ends thereof contact pieces; and at least one contact spring, said contact bridge being under pressure of said spring, said spring being convexly curved with respect to said contact bridge and being formed as a leaf spring, said leaf spring having an arresting means, said housing in a region of said window having side walls and a wall portion, said arresting means cooperating with said wall portion to to be engaged therewith, said leaf spring having two opposite ends, said contact bridge also having two opposite ends, the two opposite ends of said leaf spring and the two opposite ends of said contact bridge being concavely curved in the same direction and cooperating with each other, said contact bridge being supported in a longitudinal direction thereof by said leaf spring in a transverse direction thereof by said side walls, said leaf spring being formed with two elongated slots extended toward the opposite ends thereof.

2. The arrangement as defined in claim 1, wherein said contact bridge is formed with two elongated slots, extended toward the opposite ends thereof, the slots of the contact bridge forming two pairs of parallel elongated arms, each arm carrying thereon one of said contact pieces.

3. The arrangement as defined in claim 2, wherein said arresting means is an opening formed in said leaf spring, said wall portion being a projection extended into said window and engaged in said opening.

4. A switch bridge arrangement for safety switches, comprising a housing having at least one window; and at least one contact bridge movably positioned in said window and carrying at ends thereof contact pieces; the contact bridge being made of a spring-elastic and electrically conductive material and formed as a frame having portions which form between said contact pieces at least one contact spring, said frame being made of electrically conductive metallic, strip and having, in the middle of said window, bent-over end portions which extend inwardly of the window and closely abut against each other.

5. The arrangement as defined in claim 4, wherein said end portions having surfaces abutting against each other, said surfaces being provided with silver coating.

6. The arrangement as defined in claim 4, wherein said frame has inner ends provided with said end portions and is formed at each inner end with a recess, said housing being formed with a projection extending into said window and engaged in the recesses of said frame.

7. The arrangement as defined in claim 6, wherein said ends are provided further with downwardly projecting portions extended into said window.

8. The arrangement as defined in claim 7, wherein said frame is substantially rectangular and has a continuous bottom portion having an underside, said contact pieces being arranged on said underside 9. The arrangement as defined in claim 8, wherein said frame has two outer ends and is provided at said outer ends with two elongated opposing slots at two sides of said window.

10. The arrangement as defined in claim 8, wherein said window is defined in said housing by two supporting surfaces at which an upper portion of the frame is engaged when the frame is in an operative position.

11. A switch bridge arrangement for safety switches, comprising a housing having at least one window; at least one contact bridge movably positioned in said window and carrying thereon contact pieces; and at least one contact spring, said contact bridge being under pressure of said spring, said spring being a leaf spring and having a arresting means, said housing having a wall portion, said arresting means cooperating with said wall portion to be engaged therewith, said contact bridge having two inwardly bent end projections, said spring being formed with two openings in which said projections are engaged.

12. The arrangement as defined in claim 11, wherein said arresting means includes two semi-circular recesses formed at two opposite longitudinal edges of said spring, said wall portion being formed with two projections extended into said window and engaged in said semi-circular recesses.

13. A switch bridge arrangement for safety switches, comprising a housing having at least one window; at least one contact bridge movably positioned in said window and carrying thereon contact pieces; and at least one contact spring, said contact bridge under pressure of said spring, said spring having an arresting means, said housing having a wall portion, said arresting means cooperating with said wall portion to be engaged therewith, said contact spring being C-shaped and having two opposite ends, said contact bridge having two folded projections, said opposite ends of the spring being supported against said folded projections.

* * * * *